US010697472B2

(12) United States Patent
Hamamoto

(10) Patent No.: US 10,697,472 B2
(45) Date of Patent: Jun. 30, 2020

(54) CENTRIFUGAL COMPRESSOR

(71) Applicant: MITSUBISHI HEAVY INDUSTRIES COMPRESSOR CORPORATION, Tokyo (JP)

(72) Inventor: Kazuhiko Hamamoto, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 97 days.

(21) Appl. No.: 15/780,022

(22) PCT Filed: Dec. 22, 2015

(86) PCT No.: PCT/JP2015/006375
§ 371 (c)(1),
(2) Date: May 30, 2018

(87) PCT Pub. No.: WO2017/109816
PCT Pub. Date: Jun. 29, 2017

(65) Prior Publication Data

US 2018/0347588 A1 Dec. 6, 2018

(51) Int. Cl.
*F04D 29/58* (2006.01)
*F04D 27/02* (2006.01)
(Continued)

(52) U.S. Cl.
CPC ..... *F04D 29/582* (2013.01); *F04D 27/009* (2013.01); *F04D 27/0292* (2013.01);
(Continued)

(58) Field of Classification Search
None
See application file for complete search history.

(56) References Cited

U.S. PATENT DOCUMENTS 3,342,406 A * 9/1967 Baumann ..... F04D 29/083 415/149.4
3,653,465 A * 4/1972 Wheeler, Jr. ..... B01D 45/16 184/55.2
(Continued)

FOREIGN PATENT DOCUMENTS

JP 2000-227030 A 8/2000
JP 2013-29103 A 2/2013
WO 2013/034656 A1 3/2013

OTHER PUBLICATIONS

International Search Report issued in corresponding International Application No. PCT/JP2015/006375 dated Apr. 5, 2016, with translation (4 pages).
(Continued)

*Primary Examiner* — Michael Lebentritt
(74) *Attorney, Agent, or Firm* — Osha Liang LLP

(57) ABSTRACT

A centrifugal compressor includes: a casing; a compression mechanism disposed inside the casing; a flow rate regulation valve disposed inside the casing and that regulates a flow rate of air sucked into the casing; a conversion mechanism disposed outside the casing and that changes a direction of the flow rate regulation valve based on an output of an actuator; and a cover that surrounds and houses the conversion mechanism, wherein dry air is supplied to an inside of the cover, and the cover forms an air reservoir that prevents dew condensation on the conversion mechanism.

2 Claims, 5 Drawing Sheets

(51) Int. Cl.

| | |
|---|---|
| ***F04D 29/08*** | (2006.01) |
| ***F04D 29/46*** | (2006.01) |
| ***F04D 27/00*** | (2006.01) |
| ***F04D 29/70*** | (2006.01) |

(52) U.S. Cl.

CPC ..... *F04D 29/083* (2013.01); *F04D 29/462* (2013.01); *F04D 29/584* (2013.01); *F04D 29/706* (2013.01); *F05B 2260/20* (2013.01); *F05B 2260/64* (2013.01); *F05B 2270/303* (2013.01); *F05D 2250/51* (2013.01); *F05D 2260/608* (2013.01); *F05D 2270/311* (2013.01)

(56) References Cited

U.S. PATENT DOCUMENTS 4,492,631 A * 1/1985 Martin ..... B04B 5/005 210/127
4,815,294 A * 3/1989 David ..... F02B 71/04 123/46 A
4,995,791 A * 2/1991 Loprete ..... F04B 39/123 417/366
5,980,218 A 11/1999 Takahashi et al.
2004/0123909 A1* 7/2004 Parkkinen ..... F04B 41/00 137/563
2007/0172363 A1* 7/2007 Laboube ..... F04D 25/0606 417/370
2009/0087298 A1* 4/2009 Shibata ..... F04D 29/4206 415/1
2011/0000182 A1* 1/2011 Lasker ..... F02C 1/04 60/39.24
2012/0186605 A1* 7/2012 Nakaniwa ..... F04D 17/10 134/24
2013/0200634 A1* 8/2013 Patterson ..... F01C 3/08 290/1 R

OTHER PUBLICATIONS

Written Opinion of the International Searching Authority issued in corresponding International Application No. PCT/JP2015/006375 dated Apr. 5, 2016 (4 pages).
Extended European Search Report in counterpart European Application No. 15911256.4 dated Dec. 10, 2018 (9 pages).

* cited by examiner

FIG. 5

| AIR RESERVOIR 32 | | | DEW CONDENSATION DETERMINATION PRESENT: — ABSENT: ○ | | |
|---|---|---|---|---|---|
| TEMPE-RATURE[°C] | HUMIDITY [%] | DEW POINT θd [°C] | [θsi=−10°C] | [θsi=10°C] | [θsi=30°C] |
| 60 | 60 | 40 | — | — | — |
| | 30 | 36 | — | — | — |
| | 15 | 24 | — | — | ○ |
| | 10 | 17 | — | — | ○ |
| | 5 | 7 | — | — | ○ |
| 50 | 60 | 40 | — | — | — |
| | 30 | 28 | — | — | ○ |
| | 15 | 16 | — | — | ○ |
| | 10 | 10 | — | — | ○ |
| | 5 | 0 | — | ○ | ○ |
| 40 | 60 | 31 | — | — | — |
| | 30 | 19 | — | — | ○ |
| | 15 | 8 | — | ○ | ○ |
| | 10 | 3 | — | ○ | ○ |
| | 5 | −6 | — | ○ | ○ |
| 30 | 60 | 21 | — | — | ○ |
| | 30 | 10 | — | — | ○ |
| | 15 | 1 | — | ○ | ○ |
| | 10 | −5 | — | ○ | ○ |
| | 5 | −13 | ○ | ○ | ○ |
| 20 | 60 | 12 | — | — | ○ |
| | 30 | 2 | — | ○ | ○ |
| | 15 | −7 | — | ○ | ○ |
| | 10 | −12 | ○ | ○ | ○ |
| | 5 | −19 | ○ | ○ | ○ |
| 10 | 60 | 3 | — | ○ | ○ |
| | 30 | −6 | — | ○ | ○ |
| | 15 | −15 | ○ | ○ | ○ |
| | 10 | −19 | ○ | ○ | ○ |
| | 5 | −25 | ○ | ○ | ○ |

CENTRIFUGAL COMPRESSOR

TECHNICAL FIELD

The present invention relates to antifreeze in a centrifugal compressor that sucks and compresses air.

BACKGROUND

For example, a centrifugal compressor sucks air as a compression medium, and causes the air to flow through an impeller and a diffuser that configure a compression mechanism, to gradually decrease a speed in a radial direction, namely, a centrifugal direction, thereby compressing the air. Accordingly, if temperature of the air to be sucked is low, a mechanism on an inlet side, in particular, of the compressor that sucks the air may be frozen, which may inhibit necessary operation of the mechanism. Examples of the mechanism include a mechanism driving an inlet guide vane (IGV) that regulates a flow rate of the air to be sucked into the compressor.

Patent Literature 1 proposes that a heat exchanger be provided in an intake chamber connected to a compressor of a gas turbine, and a portion of exhaust gas of the gas turbine be supplied to the heat exchanger.

Further, Patent Literature 2 proposes that, to prevent inlet side of the compressor of the gas turbine from being frozen, high-temperature compressed air extracted from an outlet of the compressor be guided to the inlet side of the compressor to increase inlet temperature of the compressor.

As described above, Patent Literature 1 and Patent Literature 2 are both to prevent freezing by heated air.

CITATION LIST

Patent Literature

Patent Literature 1: JP 2000-227030 A
Patent Literature 2: JP 2013-029103 A

SUMMARY

The measures to prevent freezing in which the heated air is supplied to the compressor disclosed in Patent Literatures 1 and 2 have limitations. In other words, in a case where the temperature of the part to which the heated air is blown is extremely low, even the heated air is cooled to cause dew condensation when the heated air is brought into contact with the part, which may result in freezing.

One or more embodiments of the present invention provide a centrifugal compressor that makes it possible to prevent occurrence of freezing on an accompanying device without relying on heated air.

A centrifugal compressor according to one or more embodiments of the present invention includes: a casing; a compression mechanism provided inside the casing; a flow rate regulation valve that is provided inside the casing and is configured to regulate a flow rate of air sucked into the casing; a conversion mechanism that is provided outside the casing and is configured to change a direction of the flow rate regulation valve according to an output of an actuator; and a cover that covers surroundings of the conversion mechanism to house the conversion mechanism and in which an air reservoir to prevent dew condensation on the conversion mechanism through supply of dry air to an inside of the cover is formed.

The centrifugal compressor according to one or more embodiments of the present invention uses the dry air to prevent freezing. Therefore, even if the temperature of the conversion mechanism is extremely low, it is possible to avoid occurrence of dew condensation on the conversion mechanism and to prevent freezing of the conversion mechanism.

In the centrifugal compressor according to one or more embodiments of the present invention, a portion of compressed air compressed by the compression mechanism is supplied as the dry air to form the air reservoir for prevention of dew condensation.

The compressed air has low humidity as compared with the air before compression because the temperature of the compressed air is increased and supersaturated moisture is condensed. Therefore, supplying the compressed air as the dry air to the cover makes it possible to form the air reservoir for prevention of dew condensation. Further, a portion of the compressed air compressed by the compression mechanism is supplied to the cover, and it is accordingly unnecessary to provide a new air supply source for formation of the air reservoir. This makes it possible to suppress increase of the cost. Moreover, a generation source of the compressed air is the air (outside air) that is sucked from the outside and passes through the flow rate regulation valve. Therefore, the humidity of the air passing through the flow rate regulation valve and the humidity of the compressed air are substantially equal to each other. This makes it possible to more effectively prevent dew condensation on the conversion mechanism.

In the centrifugal compressor according to one or more embodiments of the present invention, in a case where the compression mechanism includes a first compression section that compresses the sucked air, a second compression section that further compresses the compressed air compressed by the first compression section, and a connection piping through which the compressed air compressed by the first compression section flows toward the second compression section, a return piping that makes the connection piping and the cover communicate with each other and causes a portion of the compressed air flowing through the connection piping to flow toward the inside of the cover may be provided.

It is possible for the centrifugal compressor according to one or more embodiments of the present invention to cause a portion of the compressed air from downstream of the second compression section to flow toward the inside of the cover. At this time, however, the compressed air compressed by the first compression section is lower in pressure than the compressed air compressed by the second compression section. Therefore, supplying the compressed air compressed by the first compression section makes it possible to suppress force of the dry air leaked from the cover and to suppress damage on surroundings of the cover even if the dry air is leaked from the cover.

In the centrifugal compressor according to one or more embodiments of the present invention including the first compression section and the second compression section, in a case where the connection piping includes a cooling dehumidifier that cools and dehumidifies the compressed air compressed by the first compression section, the return piping causes a portion of the compressed air passed through the cooling dehumidifier to flow toward the inside of the cover. This makes it possible to use the compressed air with lower humidity as the dry air. Therefore, it is possible to prevent freezing of the conversion mechanism even in a cold district in the winter season.

In the centrifugal compressor according to one or more embodiments of the present invention, the return piping includes a switching valve that opens or closes a flow path through which a portion of the compressed air flows toward the inside of the cover, and the switching valve is opened or closed based on a state of the air reservoir. In a case of high outside temperature, there is no possibility of occurrence of dew condensation on the conversion mechanism. Therefore, closing the switching valve makes it possible to wholly use the compressed air for an original use. In contrast, in a case where the outside temperature is low and there is possibility of occurrence of dew condensation on the conversion mechanism, opening the switching valve makes it possible to avoid occurrence of dew condensation on the conversion mechanism.

In a case where the actuator includes an air cylinder, the centrifugal compressor according to one or more embodiments of the present invention includes an air supply source that supplies the compressed air to the air cylinder. In one or more embodiments of the present invention, it is possible to form the air reservoir for prevention of dew condensation by supplying, as the dry air, the compressed air from the air supply source. This makes it possible to wholly use the compressed air passed through the compression mechanism for an original use while preventing dew condensation on the conversion mechanism.

According to the centrifugal compressor of one or more embodiments of the present invention, since dry air is used to prevent freezing, it is possible to avoid occurrence of dew condensation on the conversion mechanism and to prevent freezing of the conversion mechanism even if the temperature of the conversion mechanism is extremely low.

BRIEF DESCRIPTION OF DRAWINGS

FIG. 5 is a table illustrating temperature and humidity of an air reservoir and a dew point of a link mechanism that are associated with one another.

DETAILED DESCRIPTION

Embodiments of the present invention are described below with a centrifugal compressor 10 as an example.

Figure 1:
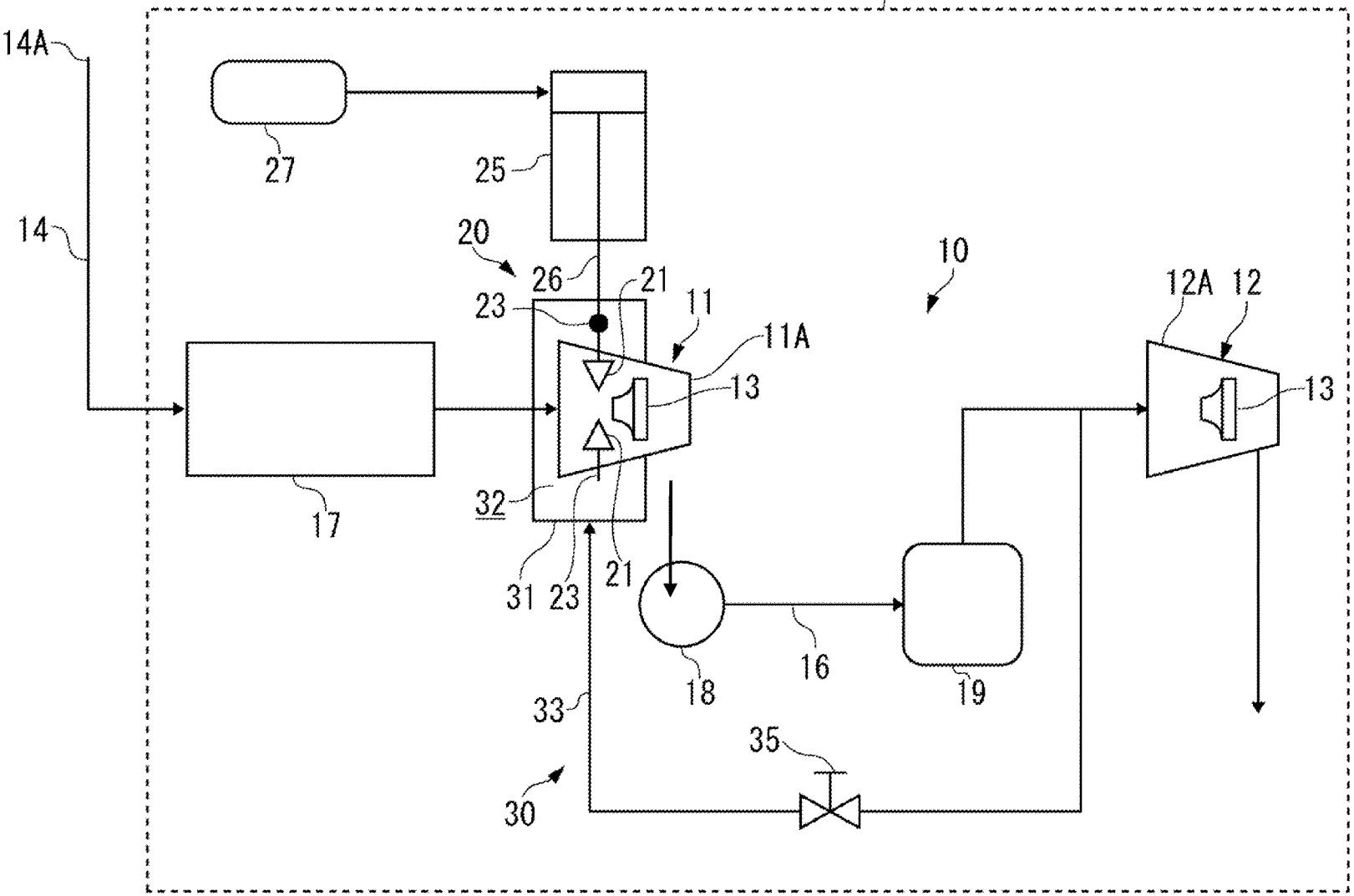
FIG. 1 is a block diagram illustrating a main configuration of a centrifugal compressor according to one or more embodiments of the present invention.

As illustrated in FIG. 1, the centrifugal compressor 10 in accordance with one or more embodiments is disposed inside a building 1, and sucks air (outside air) from outside of the building 1 and compresses the air. For example, a temperature inside the building 1 is about 25° C. The centrifugal compressor 10 includes a freezing prevention mechanism 30 that prevents an inlet guide vane (IGV) 20 serving as a movable part from being frozen and locked, when the centrifugal compressor 10 sucks the air having extremely-low temperature of about −30° C. and operates in a cold district. In the following, a configuration of the centrifugal compressor 10 is described, and then action and effects of the freezing prevention mechanism 30 are described.

[Configuration of Centrifugal Compressor 10]

The centrifugal compressor 10 includes a first compression section 11 and a second compression section 12, and is implemented as, for example, a geared type compressor. The first compression section 11 compresses sucked air, and the second compression section 12 compresses, to higher pressure, the air that has been compressed by the first compression section 11. According to one or more embodiments, upstream and downstream are defined with a direction in which the sucked air flows, as a reference.

The centrifugal compressor 10 includes an intake piping 14 through which the sucked air flows and is supplied to the first compression section 11, and a connection piping 16 that is provided between the first compression section 11 and the second compression section 12 and through which the air compressed by the first compression section 11 flows and is supplied to the second compression section 12. Here, the intake piping 14 is provided on upstream of the connection piping 16.

The first compression section 11 and the second compression section 12 respectively include impellers 13 inside a casing 11A and a casing 12A. Each of the impellers 13 includes a plurality of blades, and configures a compression mechanism when each of the impellers 13 is housed in a corresponding scroll (not illustrated).

A filter 17 is provided in the intake piping 14, and dust of the sucked air is removed through the filter 17, and the resultant air is sucked into the first compression section 11.

In addition, a cooler 18 and a drain separator (dehumidifier) 19 are provided in this order from the upstream side in the connection piping 16. When the air that has passed through the intake piping 14 and compressed (hereinafter, referred to as compressed air) passes through the cooler 18, heat generated by compression is removed. Further, when the compressed air passes through the drain separator 19, contained moisture is removed, and the resultant air is sucked into the second compression section 12. In other words, if the compressed air cooled by the cooler 18 is sucked as is into the second compression section 12, drain that is generated through condensation of moisture in the compressed air is adhered to the components such as the impeller 13 of the second compression section 12, which causes rust and corrosion. For the reason, the drain separator 19 is provided. Note that the cooler 18 and the drain separator 19 are illustrated as independent individual devices; however, a single device may include functions of both of the cooler 18 and the drain separator 19.

The compressed air that has been cooled and dehumidified is compressed by the second compression section 12 to predetermined pressure, and is then discharged from the second compression section 12. The compressed air passed through the second compression section 12 may be further compressed by providing one or a plurality of compression sections on the downstream, or may be supplied as is to a predetermined consumer.

The centrifugal compressor 10 includes an IGV 20 in the first compression section 11. The IGV 20 is provided on the upstream side of the impeller 13 inside the casing 11A of the first compression section 11, and changes a direction based on an operation state to regulate a flow rate of the air to be sucked into the first compression section 11. The IGV 20 is a flow rate regulation valve that includes a plurality of blades 21, a link mechanism 23, and an actuator 25. The blades 21 are provided in a circumferential direction. The link mechanism 23 is coupled to the plurality of blades 21 and changes directions of the plurality of blades 21. The actuator 25 drives the link mechanism 23 according to the output of the link mechanism 23. The IGV 20 drives the actuator 25 in a necessary amount when necessary, to change the directions of the blades 21, thereby regulating the flow rate of the air to be sucked into the first compression section 11.

In one or more embodiments, use of an air cylinder as the actuator 25 is assumed, and the link mechanism 23 has a function of converting linear motion of a piston rod 26 of the air cylinder into rotation motion changing the directions of the blades 21. The centrifugal compressor 10 includes an air supply source 27 that supplies compressed air to drive the air cylinder. In this case, the link mechanism 23 is provided outside the casing 11A of the first compression section 11. If the link mechanism 23 is frozen, it is not possible to change the directions of the blades 21. Note that the actuator 25 is not limited to the air cylinder, and other actuator such as an electric motor may be used.

The centrifugal compressor 10 includes the freezing prevention mechanism 30 that prevents freezing of the link mechanism 23.

The freezing prevention mechanism 30 includes a cover 31, a return piping 33, and a switching valve 35. The cover 31 covers the link mechanism 23. The return piping 33 makes the connection piping 16 on the downstream of the drain separator 19 and an inside of the cover 31 communicate with each other. The switching valve 35 is provided in the return piping 33 and opens or closes a flow path of the return piping 33.

The cover 31 covers surroundings of the casing 11A so as to house the link mechanism 23, and forms an air reservoir 32 that reserves the compressed air supplied through the return piping 33 to prevent occurrence of dew condensation around the link mechanism 23.

It is unnecessary for the cover 31 to completely seal the link mechanism 23. For example, a gap is inevitably generated between the piston rod 26 and the cover 31 at a part through which the piston rod 26 penetrates, and the compressed air is accordingly leaked. As described above, even when the cover 31 does not completely seal, dry environment inside the cover 31 can be maintained because the compressed air is supplied.

It is sufficient for the freezing prevention mechanism 30 to function only when the temperature outside the building 1 is low. Therefore, the switching valve 35 is provided in the return piping 33, and the switching valve 35 is opened (ON state) during a period when freezing of the link mechanism 23 is expected, and is closed (OFF state) in other periods. The ON/OFF state of the switching valve 35 can be changed by an operator that performs operation of the centrifugal compressor 10; however, the ON/OFF state of the switching valve 35 may be automatically changed as described below.

In the freezing prevention mechanism 30, the air (outside air) that has been sucked through the intake piping 14 and that has been compressed by the first compression section 11, is fed to the cover 31. The air that passes through the IGV 20 after being sucked and the compressed air supplied to the cover 31 have the substantially same humidity, which indicates no humidity difference between the inside and the outside of the IGV 20. This prevents dew condensation on the link mechanism 23 of the IGV 20. Accordingly, for example, a thermometer 28 (FIG. 2) is provided on the intake piping 14 to monitor the temperature (intake temperature) of the air flowing through the intake piping 14, and the switching valve 35 may be changed to the ON state when the intake temperature becomes lower than 0° C.

However, in a case where the intake temperature is fluctuated near 0° C., for example, in a case where the intake temperature is repeatedly fluctuated across 0° C., the switching valve 35 is repeatedly changed between the ON state and the OFF state. Accordingly, for example, in a case where the intake temperature becomes −1° C. and the switching valve 35 is changed to the ON state, the switching valve 35 is not changed to the OFF state even when the intake temperature exceeds 0° C. immediately thereafter. To this end, an opening holding timer may be provided, and control may be performed so that, for example, the ON state of the switching valve 35 is maintained for 30 minutes irrespective of fluctuation of the intake temperature after the switching valve 35 is changed to the ON state, and when the intake temperature exceeds 0° C. after the elapse of 30 minutes, the switching valve 35 is changed to the OFF state.

[Operation of Centrifugal Compressor 10]

Figure 2A:
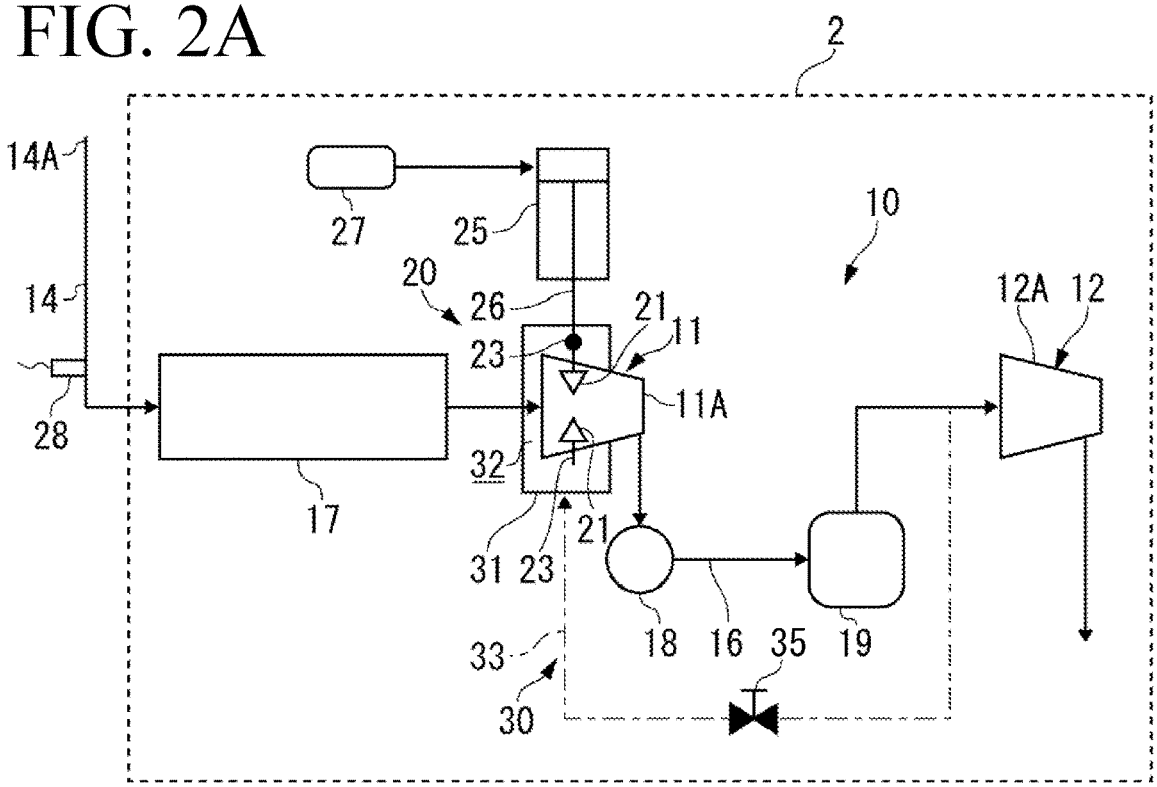
FIGS. 2A and 2B each illustrate operation of the centrifugal compressor of FIG. 1, FIG. 2A illustrating a state where a dew condensation prevention mechanism is not operated, and FIG. 2B illustrating a state where the dew condensation prevention mechanism is operated.
Figure 2B:
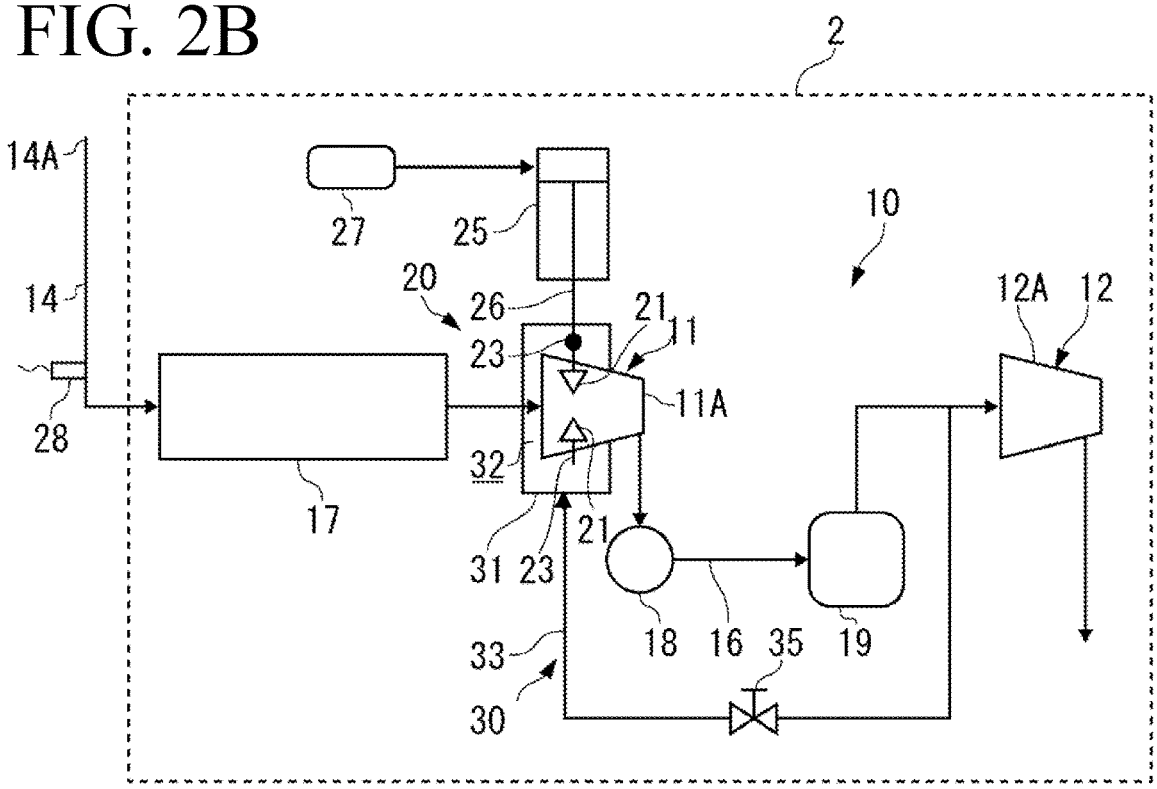

Next, operation of the centrifugal compressor 10 is described with reference to FIGS. 2A and 2B. Note that illustration of the impeller 13 is omitted in FIGS. 2, 4, and 5.

When the centrifugal compressor 10 is driven, the air is sucked through an intake port 14A of the intake piping 14, and is first compressed by the first compression section 11. The compressed air passes through the connection piping 16 and is compressed by the second compression section 12 to higher pressure, and is then discharged to a discharge piping. The opening of the IGV 20 is set small at the beginning of the driving, and the flow rate of the air sucked into the first compression section 11 is small. When the first compression section 11 and the second compression section 12 reach rated operation, the opening of the IGV 20 is increased. The opening of the IGV 20 is also varied as necessary.

For example, if the temperature measured by the thermometer 28 exceeds 0° C., the switching valve 35 is changed to the OFF state, and all of the compressed air passing through the first compression section 11 flows into the second compression section 12, and is further compressed.

When the compression by the first compression section 11 and the second compression section 12 is continuously performed, the temperature of the first compression section 11 and the link mechanism 23 becomes the temperature following the air passing through the intake piping 14 because being influenced by the air passing through the intake piping 14. However, dew condensation does not occur on the link mechanism 23 as long as an Expression (1) is satisfied, which prevents freezing.

In contrast, when the temperature measured by the thermometer 28 is equal to or lower than 0° C., the switching valve 35 is changed to the ON state, and a portion of the compressed air passing through the first compression section 11 is supplied to the inside of the cover 31 through the return piping 33. The compressed air has low humidity because the compressed air has passed through the cooler 18 and the drain separator 19. The compressed air with low humidity, namely, the dry air is continuously supplied to the inside of the cover 31, which causes the inside of the cover 31 to be filled with the dry air to form the air reservoir 32 for prevention of dew condensation on the link mechanism 23. As described above, since the air is leaked from the cover 31, it is possible to form the air reservoir 32 for prevention of dew condensation, inside the cover 31 through continuous supply of the dry air even if the air with high humidity is present inside the cover 31.

If the outside temperature is as extremely low as −30° C., the temperature of the first compression section 11 may become lower than the freezing point due to influence of the air passing through the intake piping 14. Accordingly, if the air inside the cover 31 has considerable humidity, dew condensation occurs on the surface of the link mechanism 23 and condensed moisture is frozen to inhibit operation of the link mechanism 23. Since the inside of the cover 31 is filled with the dry air, however, dew condensation is prevented or is suppressed to a minute amount even if it occurs, if the temperature of the air inside the cover 31 and the temperature on the surface of the first compression section 11 are considerably different from each other. Accordingly, it is possible to prevent freezing on the link mechanism 23 or to suppress freezing to an extent causing no trouble in the operation of the link mechanism 23 even if freezing occurs.

[Effects of Centrifugal Compressor 10]

The centrifugal compressor 10 described above achieves the following effects.

The centrifugal compressor 10 according to one or more embodiments uses the dry air to prevent freezing of the link mechanism 23, thereby avoiding occurrence of dew condensation on the link mechanism 23 serving as a conversion mechanism. This makes it possible to prevent freezing of the link mechanism 23.

In the centrifugal compressor 10 according to one or more embodiments, a portion of the compressed air that is sucked air compressed by the first compression section 11 is supplied as the dry air. The compressed air is made lower in humidity than the air before compression. Accordingly, when the compressed air is supplied as the dry air to the cover 31, it is possible to form the air reservoir 32 for prevention of dew condensation. In addition, a portion of the compressed air that is obtained by compressing the sucked outside air by the first compression section 11 is supplied to the cover 31 and it is accordingly unnecessary to provide a new air supply source for formation of the air reservoir 32. This makes it possible to suppress increase of the cost. Further, the generation source of the compressed air is the air (outside air) that is sucked from the outside and passes through the IGV 20, and humidity of the air passing through the IGV 20 and humidity of the compressed air are accordingly substantially equal to each other. This makes it possible to more effectively prevent dew condensation on the link mechanism 23.

In the centrifugal compressor 10 according to one or more embodiments, a portion of the compressed air that flows through the connection piping 16 connecting the first compression section 11 and the second compression section 12 is caused to flow toward the inside of the cover 31 through the return piping 33. Accordingly, it is possible to suppress force of the compressed air leaked from the cover 31, as compared with the case where a portion of the compressed air is caused to flow from the downstream of the second compression section 12 to the cover 31. This makes it possible to reduce influence on the operator or the surrounding environment.

The centrifugal compressor 10 according to one or more embodiments causes a portion of the compressed air that has passed through the cooler 18 and the drain separator 19 provided in the connection piping 16, to flow to the cover 31, thereby forming the air reservoir. Accordingly, it is possible to use the compressed air with lower humidity, as the dry air. This makes it possible to prevent freezing of the link mechanism 23 even in a cold district in the winter season.

The centrifugal compressor 10 according to one or more embodiments includes the switching valve 35 in the return piping 33. In a case where the outside temperature is high and there is no possibility of dew condensation on the link mechanism 23, closing the switching valve 35 makes it possible to wholly use the compressed air for an original use. In contrast, in a case where the outside temperature is low and dew condensation may occur on the link mechanism 23, opening the switching valve 35 makes it possible to avoid dew condensation on the link mechanism 23.

As described above, embodiments of the present invention are described based on the centrifugal compressor 10; however, the present invention is not limited thereto, and the configuration of the centrifugal compressor 10 may be substituted with other configuration.

For example, the centrifugal compressor 10 uses the compressed air that has passed through the drain separator 19 as the dry air; however, the present invention is not limited thereto.

Figure 3A:
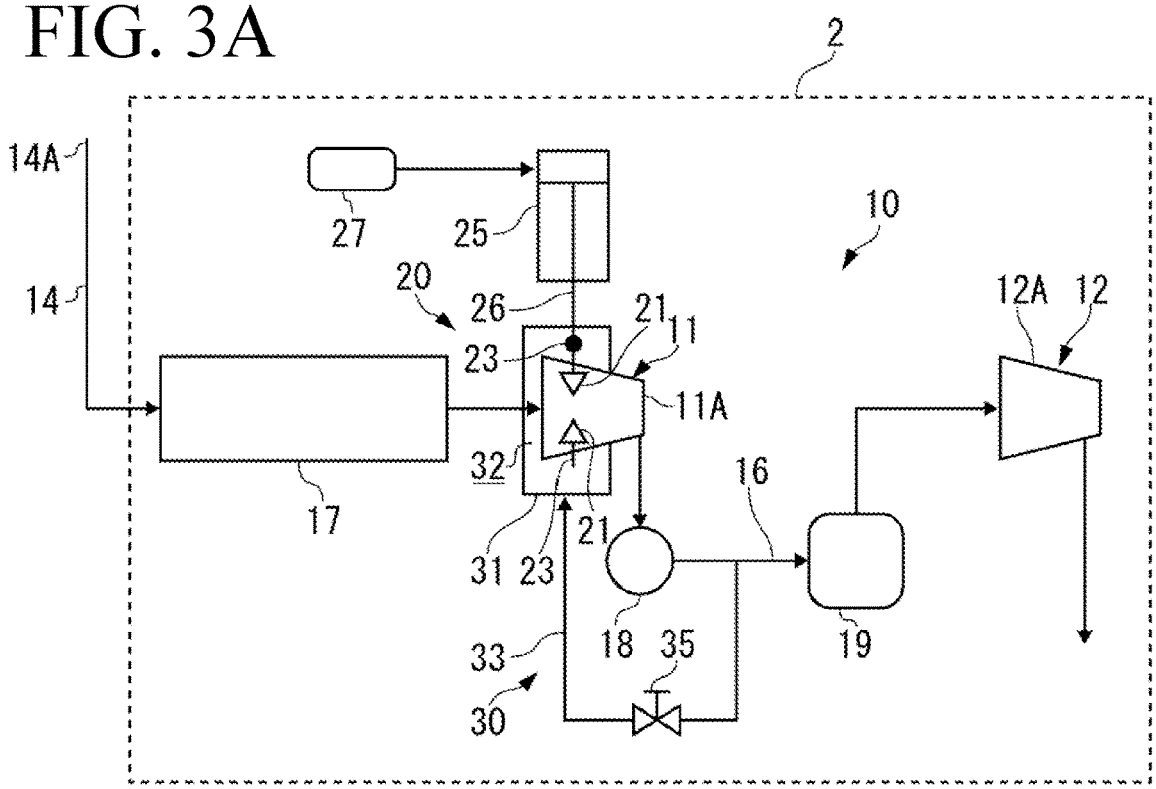
FIGS. 3A and 3B each illustrate a modification of the centrifugal compressor of FIG. 1, FIG. 3A illustrating an example in which compressed air as dry air is supplied from a portion between a first compression section and a cooler, and FIG. 3B illustrating an example in which the compressed air as the dry air is supplied from a portion between the cooler and a drain separator.
Figure 3B:
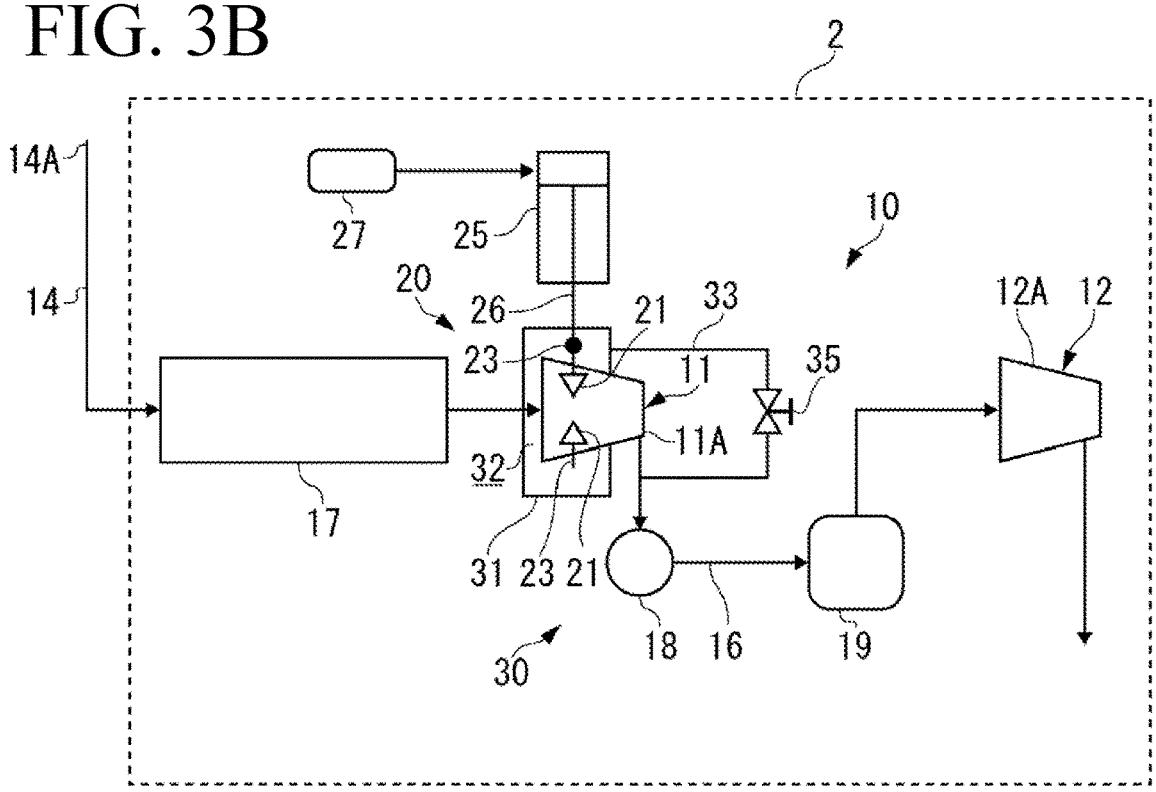

In other words, passing of the drain separator 19 is described as one example; however, it is sufficient to bring the air reservoir 32 into an atmosphere that prevents dew condensation on the link mechanism 23 as described above. Therefore, for example, as illustrated in FIGS. 3A and 3B, the return piping 33 may be provided at a position before the cooler 18 and the drain separator 19, to supply the compressed air to the air reservoir 32. In other words, it is possible to take in the compressed air from a portion between the cooler 18 and the drain separator 19 as illustrated in FIG. 3A, or from a portion between the first compression section 11 and the cooler 18 as illustrated in FIG. 3B. The compressed air is usable as the dry air because the compressed air is dehumidified through compression by the first compression section 11.

Figure 4A:
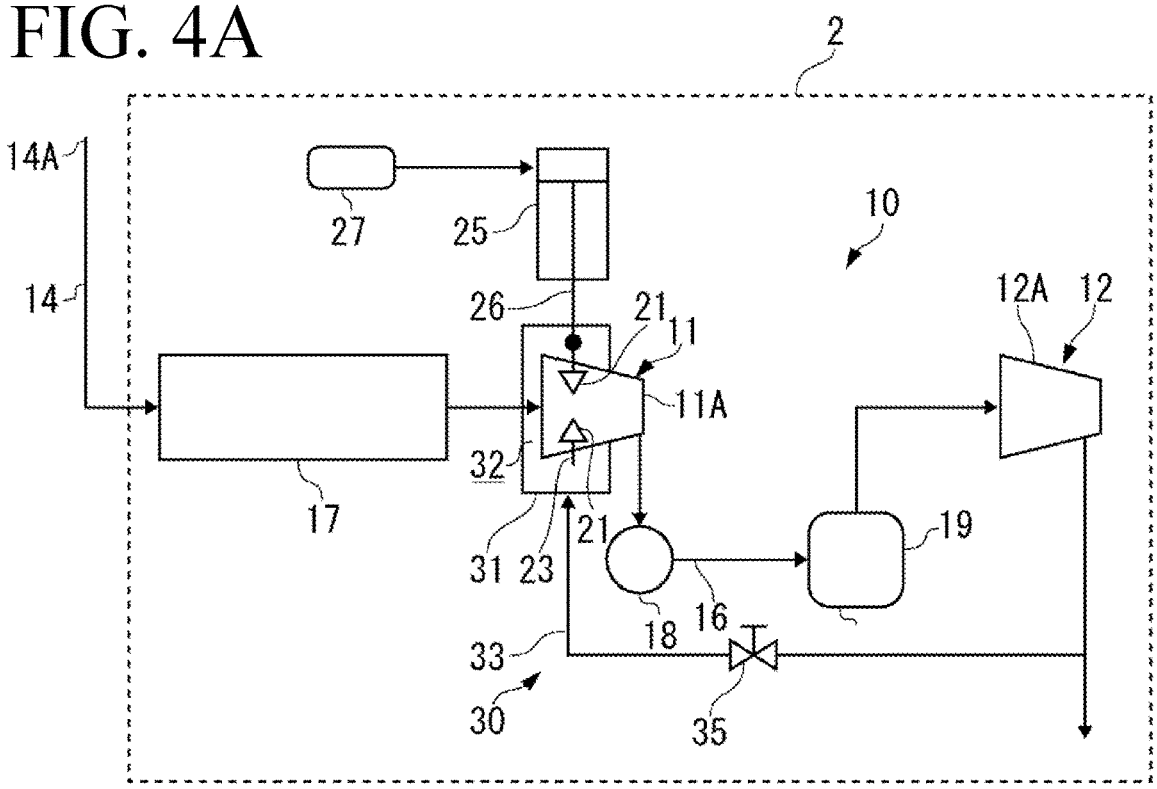
FIGS. 4A and 4B each illustrate a modification of the centrifugal compressor of FIG. 1, FIG. 4A illustrating an example in which the compressed air as the dry air is supplied from downstream of a second compression section, and FIG. 4B illustrating an example in which the compressed air as the dry air is supplied from a dry air supply source for an air cylinder.

Further, as illustrated in FIG. 4A, the return piping 33 may be connected to the downstream side of the second compression section 12, and the compressed air that has passed through the second compression section 12 may be used as the dry air.

Figure 4B:
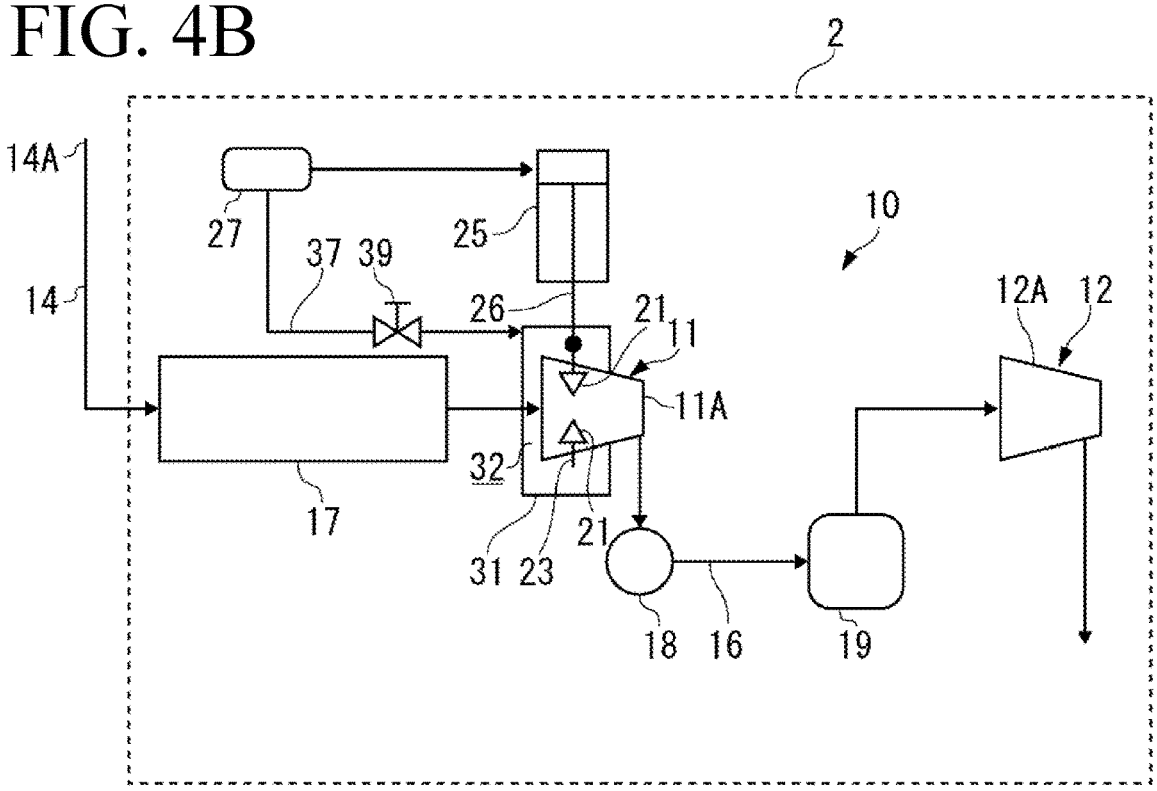

Furthermore, as illustrated in FIG. 4B, the compressed air may be supplied as the dry air to the inside of the cover 31 from the air supply source 27 that supplies the compressed air to the actuator 25 including the air cylinder. This makes it possible to wholly use the compressed air that has passed through the first compression section 11 and the second compression section 12 for an original use while preventing dew condensation on the link mechanism 23. In this case, as illustrated in FIG. 4B, a supply piping 37 that makes the air supply source 27 and the inside of the cover 31 communicate with each other and a switching valve 39 disposed in the supply piping 37 are provided, and the ON/OFF state of the switching valve 39 can be is controlled.

Moreover, in one or more embodiments of the present invention, the ON/OFF state of the switching valve (35) may be changed based on the following Expressions (1) and (2). In other words, when Expression (1) is satisfied, dew condensation does not occur on the link mechanism 23. Therefore, possibility of freezing is eliminated, and the centrifugal compressor 10 is operated while the switching valve (35) is in the OFF state. In contrast, when Expression (2) is satisfied, dew condensation occurs and freezing may occur on the link mechanism 23. Therefore, the centrifugal compressor 10 is operated while the switching valve 35 is in the ON state. In other words, the switching valve 35 is changed between the ON state and the OFF state according to the state of the air reservoir 32 with respect to the surface temperature of the link mechanism 23.

$$\theta d < \theta si \quad \text{Expression (1)}$$

$$\theta d \geq \theta si \quad \text{Expression (2)}$$

θsi: Surface temperature (° C.) of link mechanism 23

θd: Dew point (° C.) of air reservoir 32

The change of the ON/OFF state of the switching valve 35 based on Expressions (1) and (2) is particularly effective to a case where the compressed air from the other supply source of the compressed air such as the air supply source 27 and the other air compressor is supplied as the dry air to the air reservoir 32 without using the compressed air by the first compression section 11. This is because, in this case, it is assumed that the humidity is different between the air that passes through the IGV 20 after being sucked by the intake piping 14 and the compressed air supplied to the cover 31, and it is difficult to determine dew condensation only with use of the temperature of the air flowing through the intake piping 14.

In this case, it is possible to determine whether dew condensation occurs on the surface of the link mechanism 23, by Expressions (1) and (2). Accordingly, the specification (temperature and humidity) of the dry air to be supplied to the air reservoir 32 can be determined by Expression (1).

For example, θsi can be specified in the following manner.

A thermometer is actually provided on the surface of the link mechanism 23 to measure θsi.

Further, the temperature on the surface of the link mechanism 23 when the air at various temperature is sucked from the intake piping 14 is measured, and the intake temperature and the surface temperature are associated with each other and held. Further, the intake temperature is measured during operation of the centrifugal compressor 10, and the surface temperature corresponding to the intake temperature is used as θsi.

Further, θd can be determined as the temperature at which water vapor pressure of the air reservoir 32 becomes saturated water vapor pressure in a psychrometric chart.

A specific determination example is described with reference to FIG. 5.

FIG. 5 illustrates the dew points θd when the temperature and the humidity of the air reservoir 32 are specified, and presence/absence of dew condensation at some θsi relative to the dew points θd.

For example, in FIG. 5, when the temperature of the air reservoir 32 is 60° C. and the humidity is 15%, the dew point θd of the air reservoir 32 is 24° C., which indicates that the dew condensation does not occur when the surface temperature θsi of the link mechanism 23 exceeds 24° C. Further, in FIG. 3, when the temperature of the air reservoir 32 is 30° C. and the humidity is 5%, the dew point θd of the air reservoir 32 is −13° C., which indicates that the dew condensation does not occur when the surface temperature θsi of the link mechanism 23 exceeds −13° C.

In a case where the outside temperature is high as in summer season, if the surface temperature θsi of the link mechanism 23 is as high as 30° C., and the temperature of the air reservoir 32 is 30° C. (case A), dew condensation does not occur on the link mechanism 23 even at the humidity of the air reservoir 32 of 60%. In other words, in the case A, it is unnecessary to supply the dry air to the air reservoir 32, and thus the centrifugal compressor 10 is operated while the switching valve 35 is in the OFF state.

In contrast, in a case where the outside temperature is low as in the winter season, even if the surface temperature θsi of the link mechanism 23 is as low as −10° C., and the temperature of the air reservoir 32 is 30° C. (case B), dew condensation does not occur on the link mechanism 23 as long as the humidity of the air reservoir 32 is 5%. To bring the air reservoir 32 into such environment, it is necessary to supply the dry air that has temperature of 30° C. and humidity of about 5% or lower, to the inside of the cover 31.

When the compressed air that has passed through the first compression section 11 is caused to pass through the cooler 18 and the drain separator 19, it is possible to change the temperature to 30° C. and to change the humidity to 5% or lower. Therefore, the centrifugal compressor 10 is operated while the switching valve 35 is in the ON state.

As is obvious from the above description, the specification of the dry air to be supplied to the air reservoir 32 should be set, based on the above-described Expression (1), so as not to cause dew condensation on the link mechanism 23, according to the surface temperature θsi of the link mechanism 23.

Other than the above, the configurations described in the above-described embodiments may be selected or appropriately modified without departing from the scope of the present invention.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Building
10 Centrifugal compressor
11 First compression section
12 Second compression section
13 Impeller
14 Intake piping
14A Intake port
16 Connection piping
17 Filter
18 Cooler
19 Drain separator
21 Blade
23 Link mechanism
25 Actuator
26 Piston rod
27 Air supply source
30 Freezing prevention mechanism
31 Cover
32 Air reservoir
33 Return piping
35 Switching valve
37 Supply piping
39 Switching valve

The invention claimed is:

1. A centrifugal compressor, comprising:

a casing;

a compression mechanism disposed inside the casing to compress air sucked into the casing;

a flow rate regulation valve disposed inside the casing and that includes a plurality of blades, wherein the flow rate regulation valve regulates a flow rate of air sucked into the casing by changing a direction of the plurality of blades;

a conversion mechanism disposed outside the casing and that changes an output of an actuator into rotation motion to change the direction of the plurality of blades of the flow rate regulation valve; and a cover that surrounds and houses the conversion mechanism, wherein dry air is supplied to an inside of the cover, and the cover forms an air reservoir that prevents dew condensation on the conversion mechanism, a portion of compressed air compressed by the compression mechanism is supplied as the dry air to form the air reservoir, and the compression mechanism comprises:

a first compression section that compresses the sucked air;

a second compression section that further compresses the compressed air compressed by the first compression section;

a connection piping through which the compressed air compressed by the first compression section flows toward the second compression section; and a return piping that makes the connection piping and the cover communicate with each other and causes a portion of the compressed air flowing through the connection piping to flow toward the inside of the cover, wherein the connection piping comprises a cooling dehumidifier that cools and dehumidifies the compressed air compressed by the first compression section, and the return piping causes a portion of the compressed air that has passed through the cooling dehumidifier to flow toward the inside of the cover.

2. The centrifugal compressor according to claim 1, wherein the return piping comprises a switching valve that opens or closes a flow path through which the portion of the compressed air flows toward the inside of the cover, and the switching valve is opened or closed based on a state of the air reservoir.

* * * * *